United States Patent [19]

Soodalter

[11] 4,031,789

[45] June 28, 1977

[54] MEAT CUBING MACHINE

[76] Inventor: Arnold Soodalter, University Park Apts., Apt. M-1, Easthampton Road, Holyoke, Mass. 01040

[22] Filed: July 29, 1976

[21] Appl. No.: 709,940

Related U.S. Application Data

[63] Continuation-in-part of Ser. No. 602,269, Aug. 6, 1975, Pat. No. 3,990,336.

[52] U.S. Cl. ..... 83/404.2; 83/835

[51] Int. Cl.² ..... B26D 3/18

[58] Field of Search ..... 83/404.2, 408, 425.1, 83/425.3, 835

[56] References Cited

UNITED STATES PATENTS

| | | | |
|---|---|---|---|
| 1,357,829 | 11/1920 | Anstice | 83/404.2 |
| 1,726,356 | 8/1929 | Linde | 83/408 |
| 2,161,891 | 6/1939 | Spang | 83/404.2 |
| 3,261,383 | 7/1966 | Coblentz | 83/404.2 X |
| 3,841,186 | 10/1974 | Demerin | 83/404.2 |
| 3,927,592 | 12/1975 | Nienstedt | 83/404.2 |

*Primary Examiner*—Willie G. Abercrombie
*Attorney, Agent, or Firm*—Ross, Ross & Flavin

[57] ABSTRACT

A meat cuber for cubing frozen meat, wherein a three-stage cutting system includes a first cutting means in the form of a reciprocating knife having a plurality of equi-spaced alternately offset teeth for permitting reclaiming of meat dust as the knife reciprocates, a second cutting means in the form of a plurality of annular, rotating, saw tooth blades for cutting the so severed slab into a plurality of elongated strips, and a third cutting means in the form of a plurality of annular, rotating, saw tooth blades for cutting each of the so cut strips transversely into a plurality of cubes, the teeth of the second and third cutting means also permitting reclaiming of meat dust as the blades rotate.

5 Claims, 18 Drawing Figures

MEAT CUBING MACHINE

This application is a continuation-in-part of application Ser. No. 602,269 filed Aug. 6, 1975, now U.S. Pat. No. 3,990,336.

The invention described in my prior application provides a simple, economical and efficient machine for quickly and easily cubing meat, whether it be in a fresh or frozen state by use of a reciprocating knife or rotating bandsaw as a first cutting means, a first set of rotating knives as a second cutting means, and a second set of rotating knives as a third cutting means.

I have found that in cutting and cubing frozen meat, the meat dust produced by the cutting means is lost unless some means is provided for reclaiming same.

I solve this problem herein by the provision of a knife and saw blades of novel design which permit a large portion of the meat dust produced during cutting to readhere to the meat product.

Figure 13:
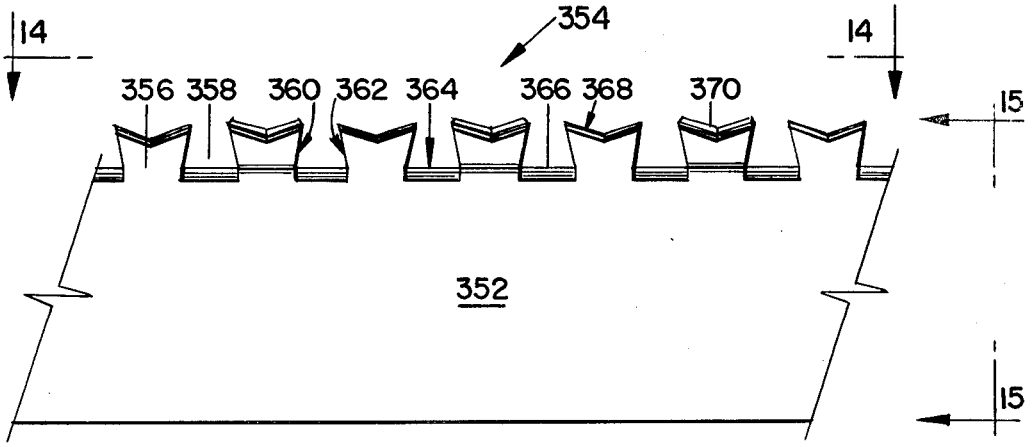
FIG. 13 is an enlarged, fragmentary top plan view of a second modified form of first cutting means for use with frozen meat.
Figure 14:
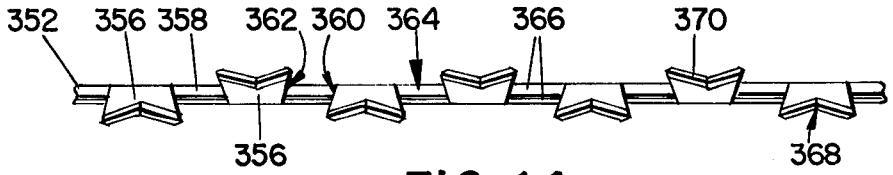
Figure 15:
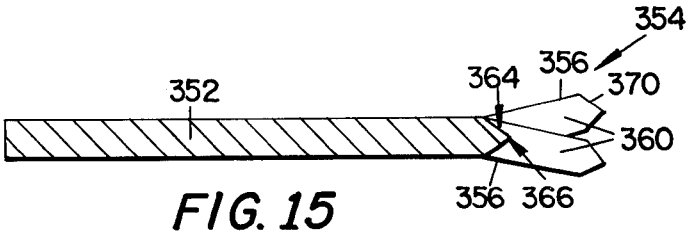
Figure 16:
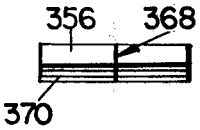
Figure 16A:
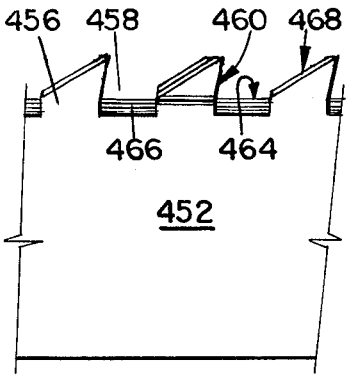
Figure 17:
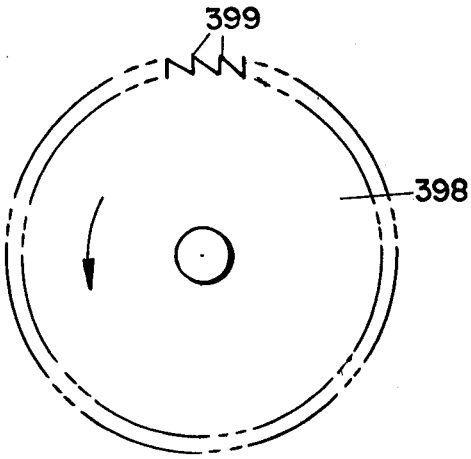

FIGS. 14 and 15 are views on lines 14—14 and 15—15 respectively of FIG. 13;

FIG. 16 is an enlarged front elevational view of one of the teeth of the blade of FIGS. 13–15;

FIG. 16*a* is an enlarged, fragmentary top plan view of a third modified form of first cutting means for use with frozen meat; and FIG. 17 is an enlarged front elevational view of a first modified form of second and third cutting means for use with frozen meat.

The apparatus is supported upwardly by a table 10 and envisions primary, secondary and tertiary cutting means 12, 14 and 16 respectively.

A base 18 is supported by table 10 and mounts a first pair of spaced, parallel guides 20, 20 extending upwardly therefrom. Guide 20 defines a first work channel 22 therebetween.

A first meat ram 24 is disposed in first work channel 22 between guides 20, for horizontal sliding movement between a channel lower wall 26 fixed to and resting on base 18, and a channel upper wall 28 fixed to and resting on guide 20.

Limit fingers 30 extend inwardly from each guide 20, ride in slots 32 in the side walls of first meat ram 24, and are fixed to adjusting handles 34 for rotation relative to the guides. They define, with slots 32, the inner and outer limits of the stroke of first meat ram 24.

A hopper 36, mounted for horizontal sliding movement relative to the upper face of channel upper wall 28, is open at its upper and lower ends.

A cover 38 may be slidably disposed in the hopper and rest on meat M disposed therein, the meat in turn resting on channel lower wall 26.

The hopper is slidable relative to a pair of spaced, horizontally extending guide rods 40, 40 disposed upwardly of guides 20, each guide rod extending through the hopper and being fixed at its opposite ends to forward and rearward abutment blocks 42 and 44 respectively fixed to the guides.

A horizontally extending push rod 46, disposed upwardly of first meat ram 24, is fixed at its inner end to the rear wall of hopper 36 and, at its opposite end, passes freely through an upright bracket 48 on the first meat ram. Push rod 46 has a limit collar 50 on its outer free end for function as a stop upon abutment with upright bracket 48.

Primary cutting means 12 includes a cutting blade 52 which extends transversely between the guide members 20 and has a beveled cutting knife edge 54 which faces the meat hopper, the cutting blade being mounted for horizontal reciprocating movement relative to the upper surface of each guide 20.

Cutting blade 52 is intended for use with fresh meat product. special blades for cutting frozen meat product will be described hereinafter with reference to FIGS. 11–16*a*.

Cutting blade 52 is strategically disposed so as to slice a slab from the lower side of meat M as hopper 36 and first meat ram 24 are moved forwardly, movement of the hopper and first meat ram being effected by exerting an inward pressure on collar 50 and upright bracket 48.

Figure 4:
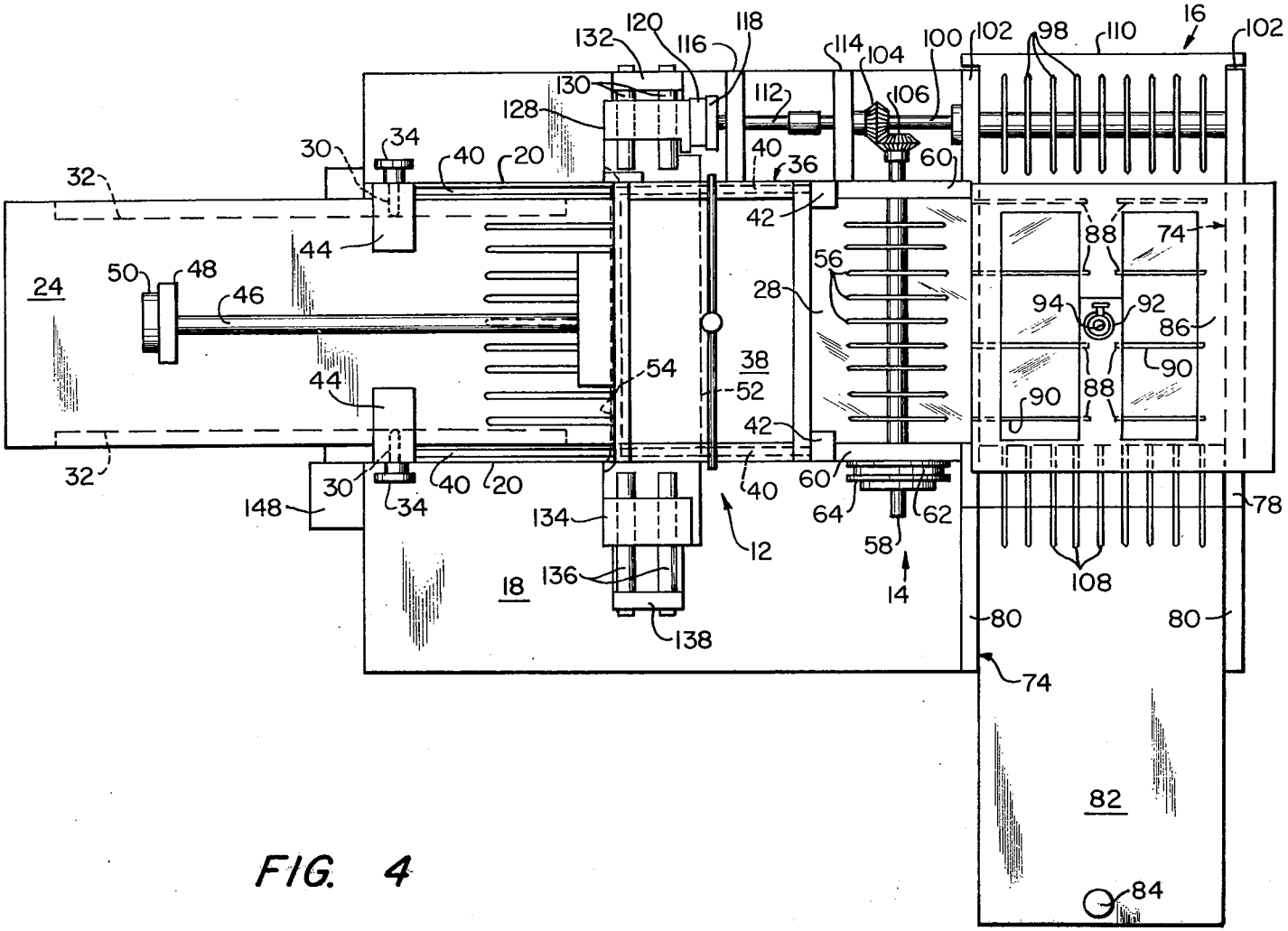
FIG. 4 is a view similar to FIG. 3 with components moved to the first cutting position.

Continued inward pressure brings the hopper into contact with forward abutment blocks 42, precluding further forward movement of the hopper, with meat M now resting on the upper surface of channel upper wall 26, and the cut slab being disposed below channel upper wall 28 within first meat channel 22, and with the forward edge of first meat ram 24 abuting the rear edge of the slab. The apparatus is now in the FIG. 4 position.

The slab is disposed immediately rearwardly of and is ready for cutting by secondary cutting means 14, which comprises a plurality of spaced, annular, rotatable cutting knives 56 having smooth beveled knife edges and mounted on a shaft 58 extending tranversely between and journalled in spaced end plates 60 extending upwardly from guides 20.

Cutting knives 56 are intended for use with fresh meat product. Special knives for cutting frozen meat product will be described hereinafter with reference to FIG. 17.

Shaft 58 is rotated by a belt 62 entrained around a pulley 64 mounted thereon, around an idler pulley 66 on table 10, and around a drive pulley 68 fixed to the drive shaft of a motor 70 on table 10.

Figure 5:
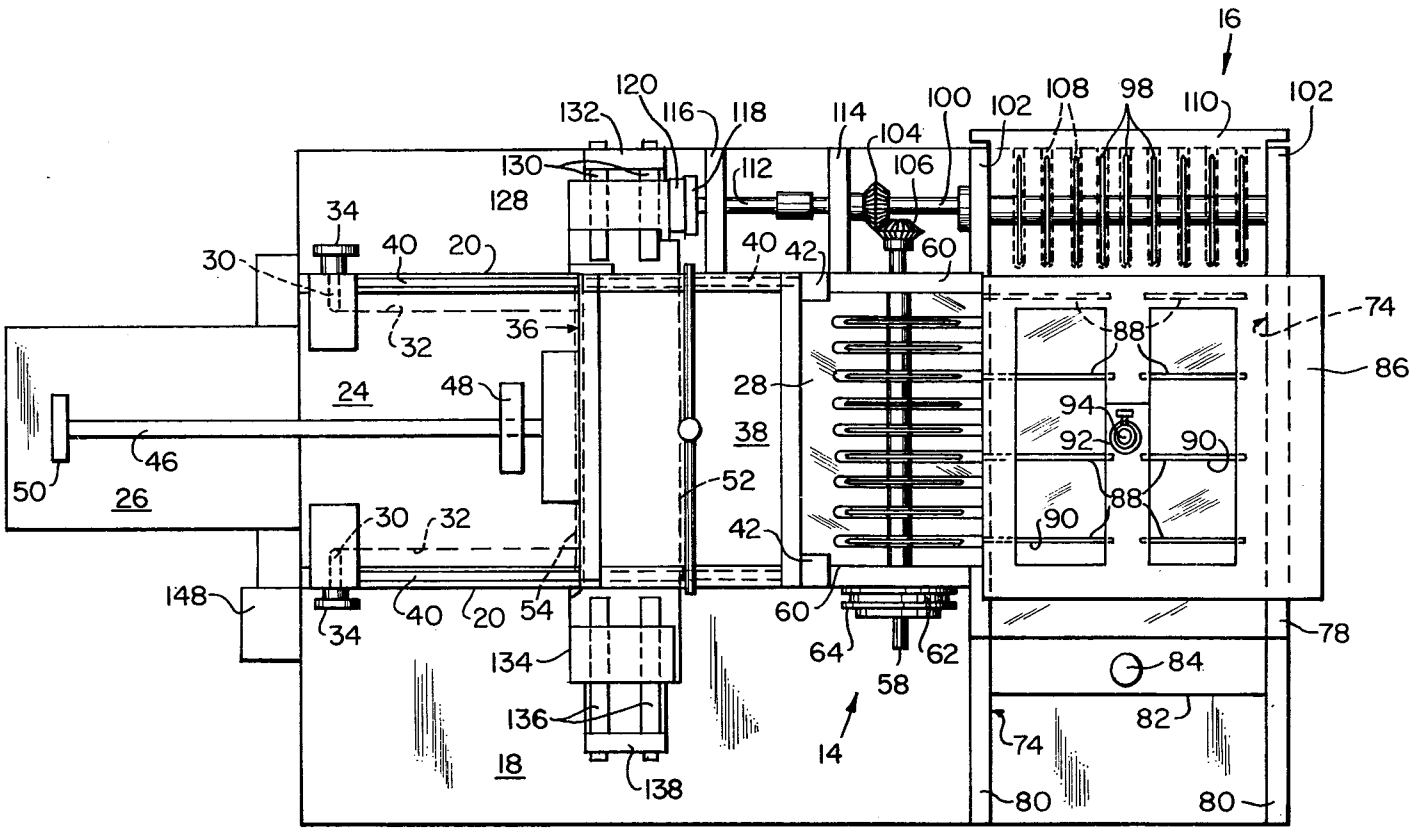
FIG. 5 is a view similar to FIG. 3 with components moved to the second and third cutting positions.
Figure 6:
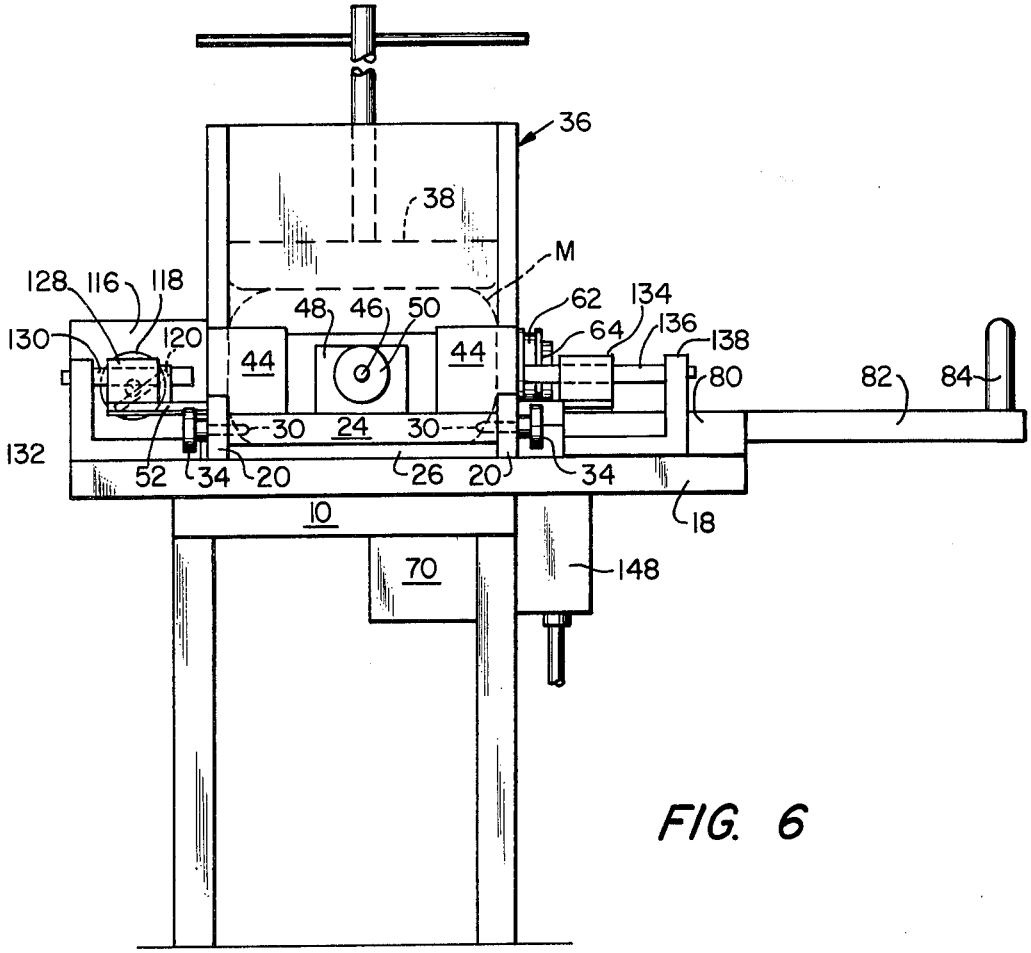
FIG. 6 is a view in end elevation as seen from the left of FIG. 1.
Figure 7:
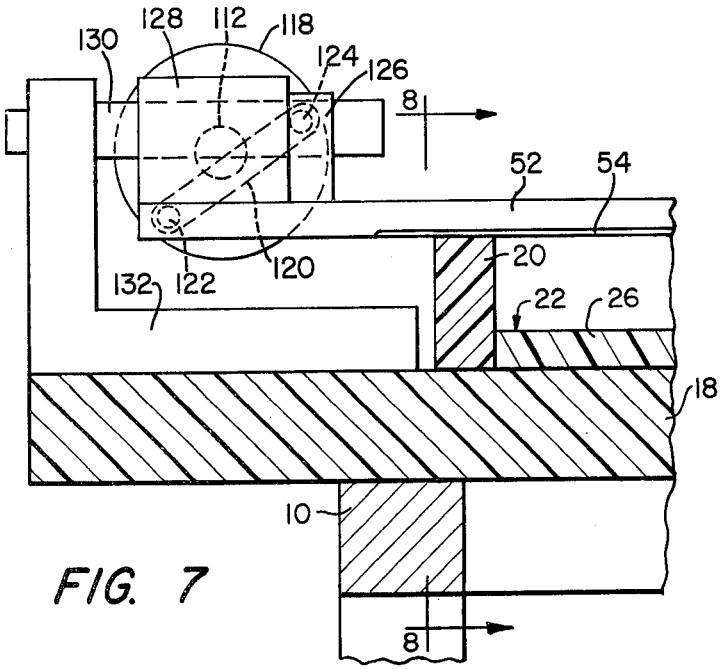
FIG. 7 is an enlarged sectional view on line 7—7 of FIG. 3.
Figure 8:
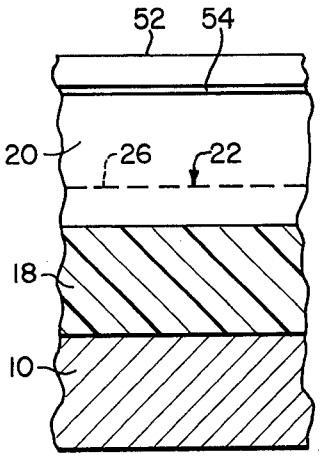
FIG. 8 is a sectional view on line 8—8 of FIG. 7.

First meat ram 24 may now be moved forwardly within first meat channel 22 to the FIG. 5 position, with bracket 48 sliding along and relative to push rod 46, the forward end of the meat ram being provided with a plurality of spaced slots 72. Each such slot is aligned with a cutting knife 56 for providing necessary clearance to permit passage of the forward edge of the first meat ram past the knives.

Forward pressure on first meat ram 24 is such as to force the slab into the paths of rotating cutting knives 56 for cutting the slab into a plurality of strips, and to force these strips into a second meat channel 74 immediately forward of secondary cutting means 14. Second meat channel 74 is normal to, in communication with, and on a plane with first meat channel 22.

Second meat channel 74 includes a second channel lower wall 76 fixed to and resting on base member 18 on a plane with first channel lower wall 26, and a second channel upper wall 78 on a plane with first channel upper wall 28.

Second channel upper wall 78 rests on a second pair of spaced, parallel and upstanding guides 80, 80 extending upwardly from base 18, these guide members being disposed normal to first guides 20.

A second meat ram 82 is disposed in second meat channel 74 is adapted for sliding movement relative to the channel by force exerted on a handle 84 extending upwardly from the second meat ram adjacent its free outer end.

Immediately forward of secondary cutting means 14 and overlying second meat channel 74 is a movable strip guide plate 86, which includes a plurality of spaced partitions 88 depending therefrom into the second meat channel for guiding the strips of meat and keeping them in alignment as they are pushed into the second meat channel by first meat ram 24. Partitions 88 are aligned with certain of the cutting knives 56 of the secondary cutting means and pass freely downwardly through slots 90 in second channel upper wall 78.

So long as strip guide plate 86 is in a lowered position, partitions 88 are disposed within second meat channel 74, wherefore second meat ram 82 cannot be moved inwardly.

Means for moving strip guide plate 86 upwardly to move partitions 88 out of second meat channel 74 includes an upright handle 92 fixed to the upper face of the strip guide plate and sleeves an upright slide post 94 fixed to the upper face of channel upper wall 78.

By grasping handle 92, strip guide plate 86 may be moved upwardly and downwardly relative to slide post 94, moving partitions 88 accordingly out of and into second meat channel 74.

A stop collar 96 on the slide post defines the upper limit of movement of handle 92 and the strip guide plate.

Figure 9:
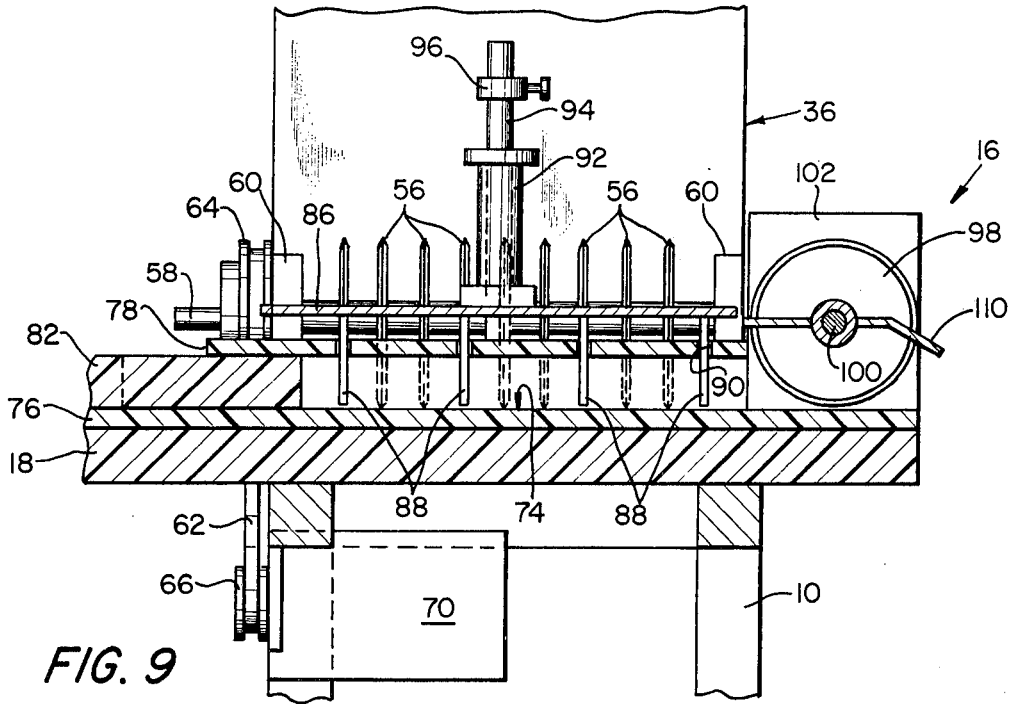
FIG. 9 is an enlarged sectional view on line 9—9 of FIG. 3.

In FIG. 9, the partitions are shown in a lowered position disposed in the second meat channel.

Figure 10:
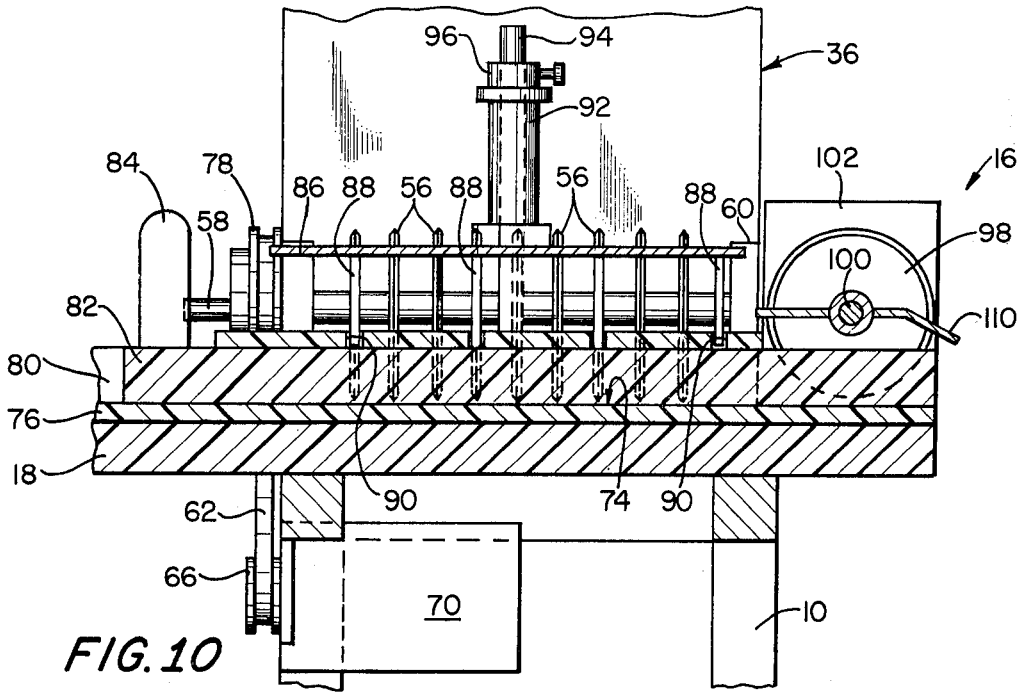
FIG. 10 is a view similar to FIG. 9, with the apparatus on the third cutting position.

In FIG. 10, the partitions are shown in a raised position, with their lower ends disposed above the plane of the lower face of channel upper wall 78, wherefore second meat ram 82 is movable into the second meat channel.

Tertiary cutting means 16, disposed at the outboard end of second meat channel 74, comprises a plurality of spaced, annular, rotatable cutting knives 98 having smooth, beveled knife edges and mounted on a shaft 100 extending transversely between and journalled in spaced end plates 102 extending upwardly from guide members 80.

Cutting knives 98 are intended for use with fresh meat product. Special knives for cutting frozen meat product will be described hereinafter with reference to FIG. 17.

Shaft 100 extends outboard of innermost end plate 102 and has a first bevel gear 104 fixed thereto and meshing with a second bevel gear 106 fixed to an extension of shaft 58 of second cutting means 14. Rotation of shaft 58 driven by motor 70 sets up a concomitant rotation of shaft 100 and cutting knives 98 of tertiary cutting means 16.

The inboard end of second meat ram 82 is provided with a plurality of spaced slots 108, each slot being aligned with a cutting knife for providing necessary clearance to permit passage of the inboard end of the second meat ram therepast.

Inward pressure on the second meat ram forces the cut strips into the paths of the rotating cutting knives 98 to cut the strips into cubes.

A deflector 110 on the tertiary cutting means deflects the cubes of meat downwardly into a container or conveyor, not shown, for further processing.

An extension 112 on shaft 100 of tertiary cutting means 16 is journalled in a pair of end plates 114 and 116 which extend upwardly from base 18 outwardly of one side of first meat channel 22.

Rotation of shaft 100 through gears 104, 106 set up a concomitant rotation of shaft extension 112 and thus a reciprocating movement of primary cutting means 12 through an eccentric 118 fixed to the inboard free end of shaft extension 112 and having one end of an arm 120 pivoted thereto by a pivot pin 122.

The opposite or upper end of arm 120 is pivoted by a pin 124 to an extension 126 of a block 128 fixed to the upper face of cutting blade 52.

A pair of spaced, parallel, horizontally disposed slide rods 130, 130 passes freely through block 128. The slide rods are fixed at their outer ends to an upstanding bracket 132 fixed to base 18.

The opposite end of cutting blade 52 is similarly supported and is fixed to the lower face of a block 134 leaving a pair of spaced, parallel, horizontally disposed slide rods 136, 136 passing freely therethrough, the slide rods being fixed at their outer ends to an upstanding bracket 138 fixed to base 18.

Rotative movement of shaft extension 112 is translated to reciprocatory movement of cutting blade 52 by eccentric 118 and arm 120, with blocks 128 and 134 sliding relative to stationary slide rods 130 and 136.

Cutting knife 52 reciprocates relative to channel upper wall 28 of first meat channel 22.

Power to the appartus is delivered from a source through a junction box 148 on table 10.

Figure 1:
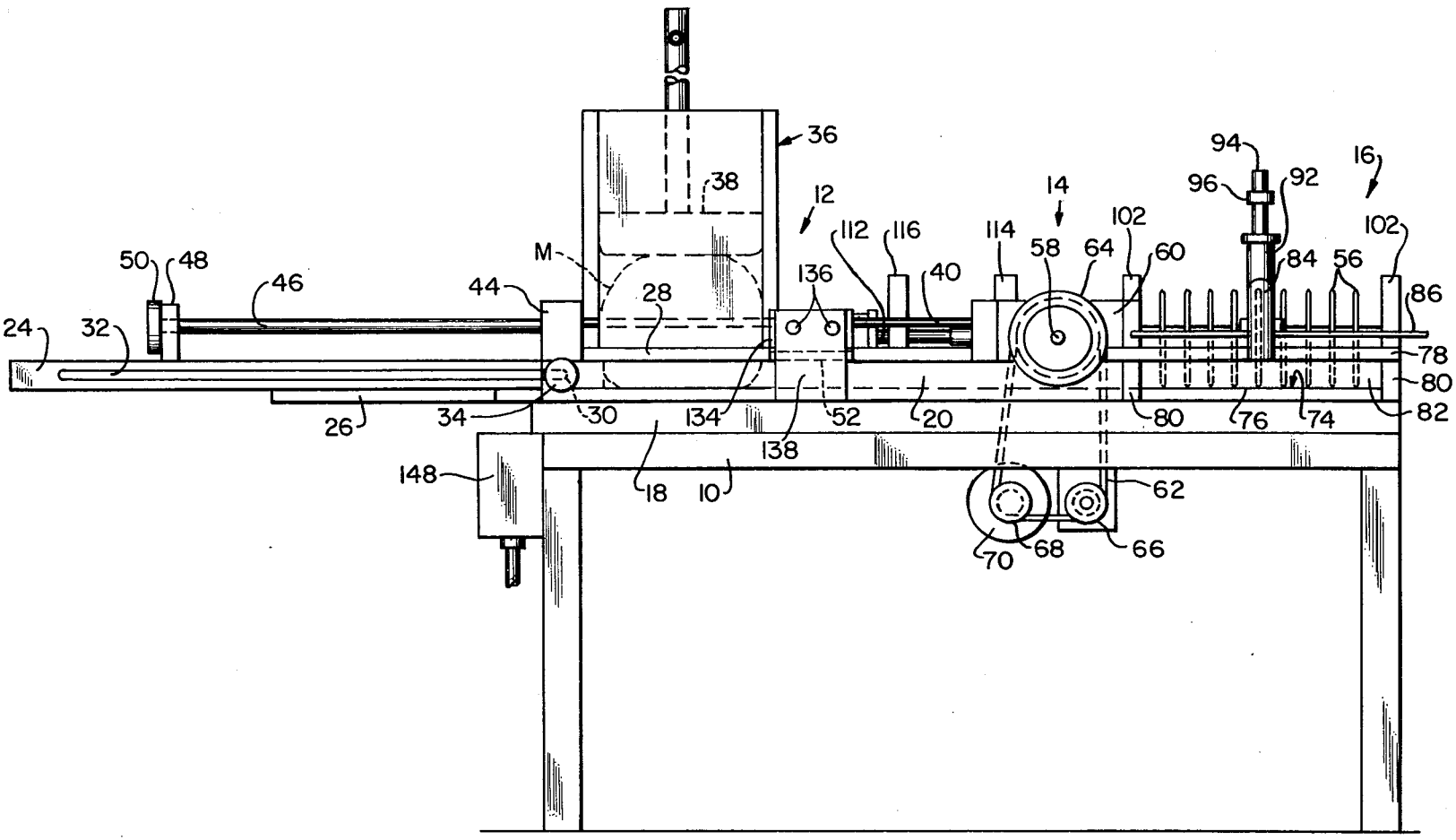
FIG. 1 is a view in front elevation of a meat cubing machine embodying one form of the invention.
Figure 2:
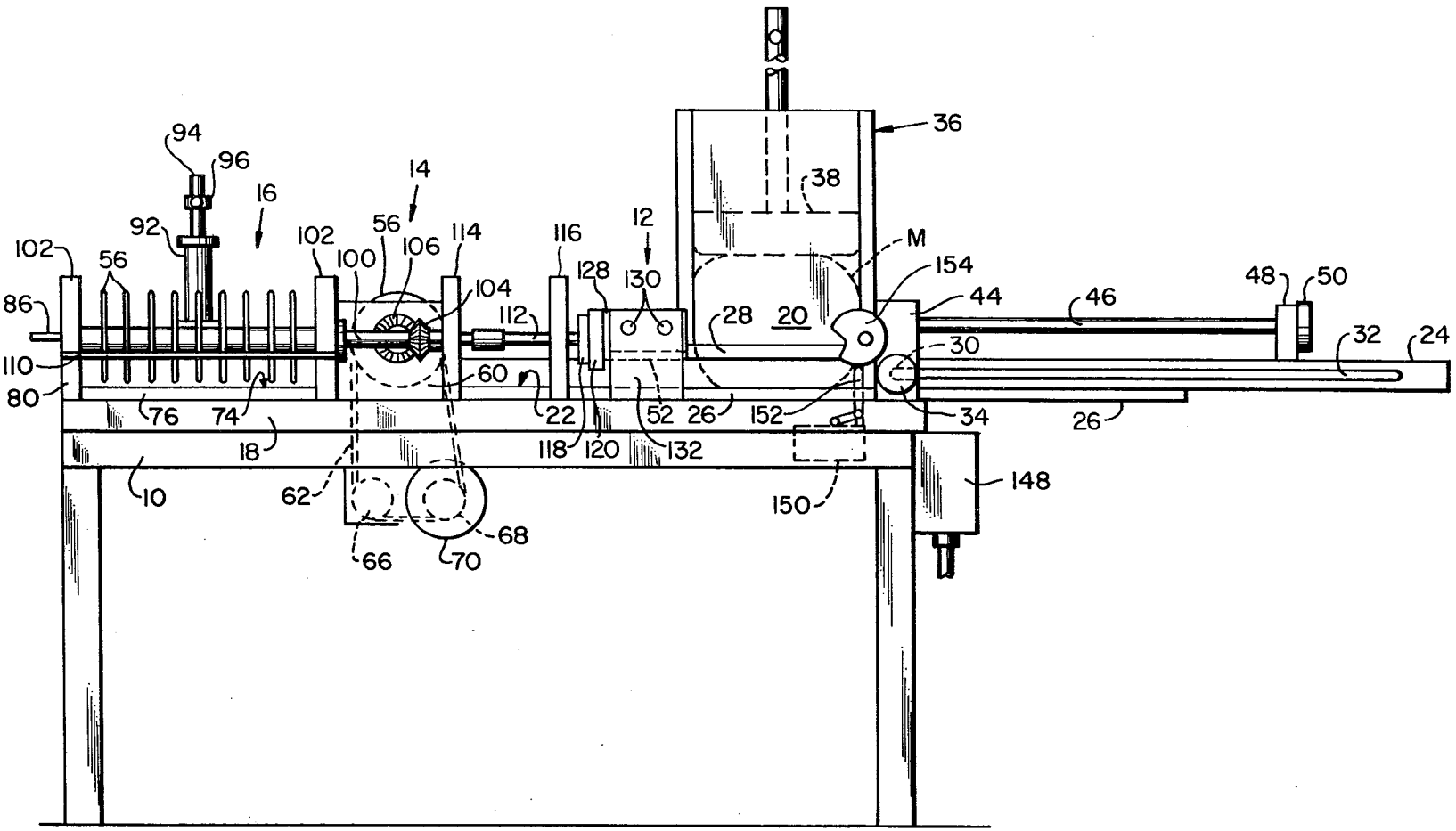
FIG. 2 is a view in rear elevation of the FIG. 1 machine.
Figure 3:
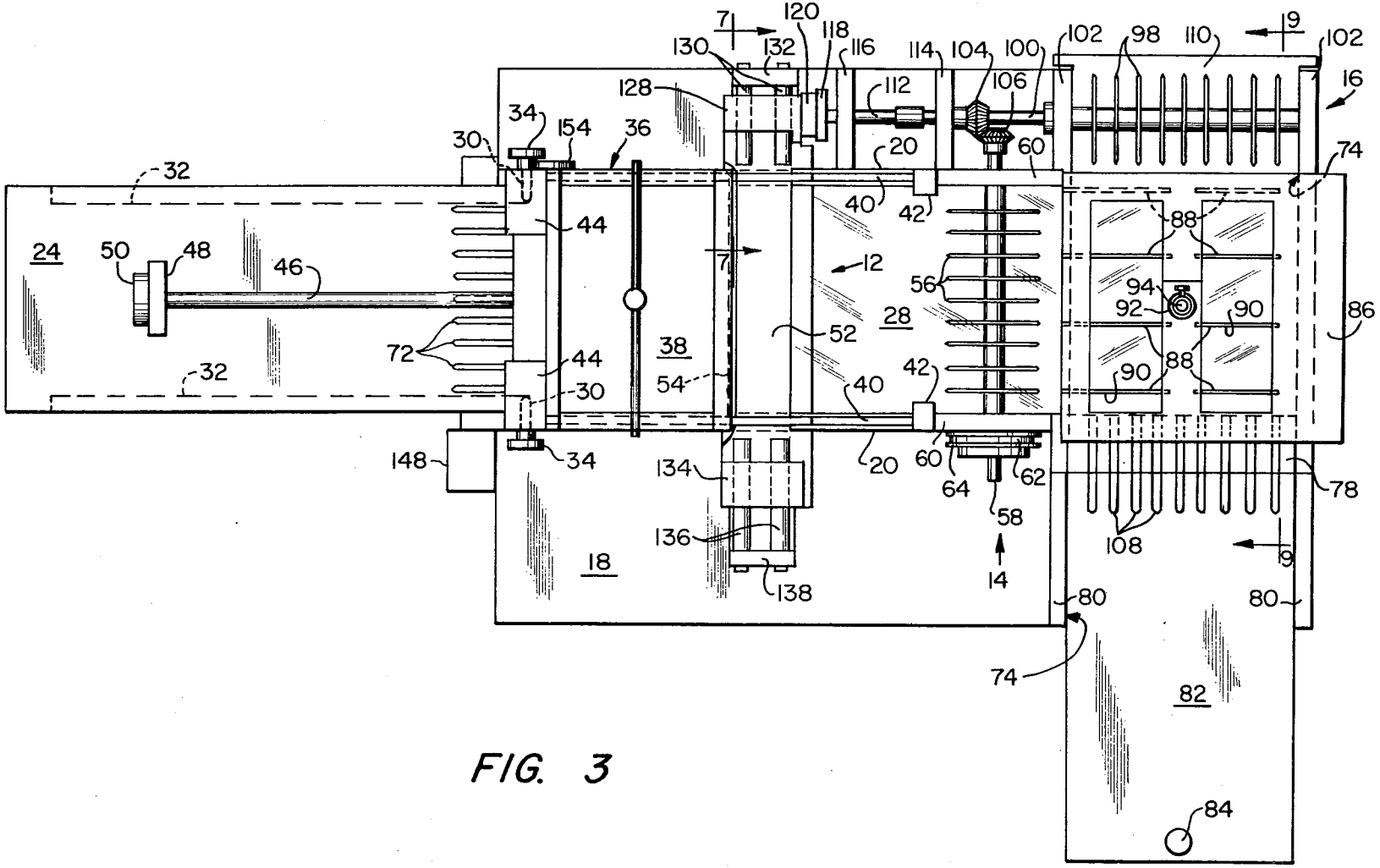
FIG. 3 is a view in top plan.

Actuation of the cutting knives is controlled by a switch 150, see FIG. 2, also mounted on table 10 and having an upright contact finger 152 extending upwardly through base 18 and so positioned as to be contacted by a cam 154 fixed to the rear wall of hopper 36.

When cam 154 contacts finger 152, the switch is opened whereby motor 70 is deactivated to stop movement of the cutting means. When the hopper is moved forwardly so that the cam clears finger 152, the switch is closed to activate the motor and the cutting means.

While an eccentric type drive has been shown and described for reciprocating the primary cutting means, I do not desire to be limited thereto, since any other suitable type of drive may be employed.

Figure 11:
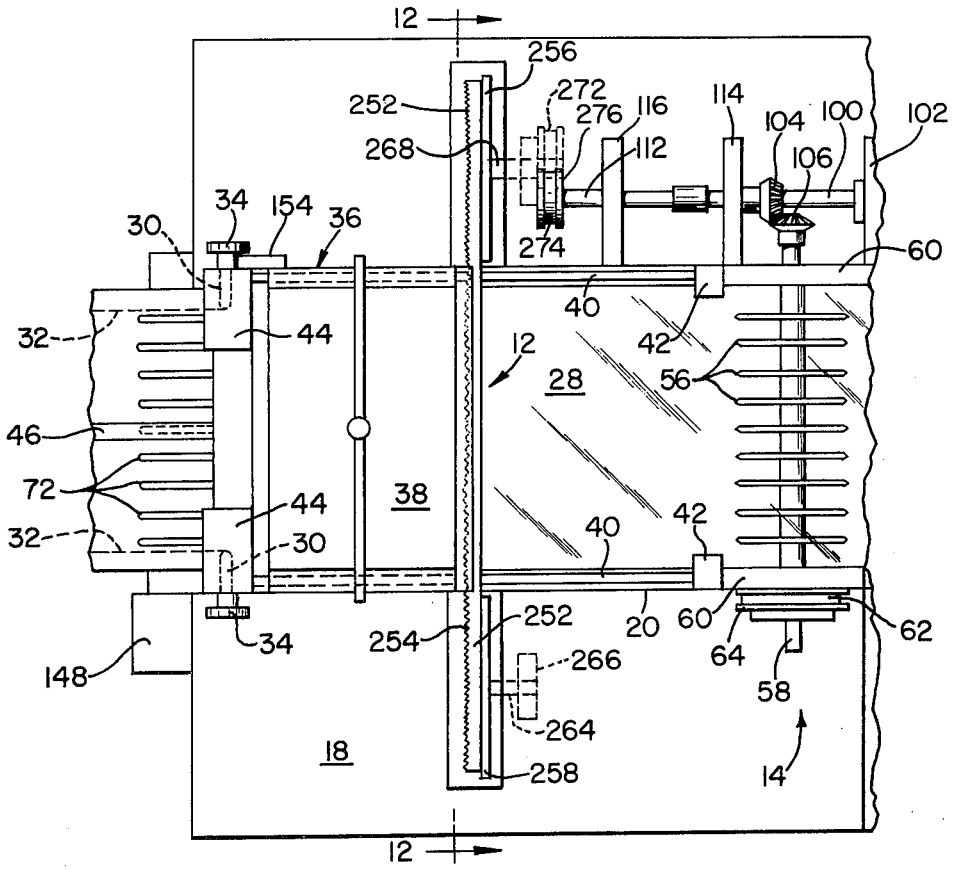
FIG. 11 is a fragmentary view in top plan of a first modified form of first cutting means.
Figure 12:
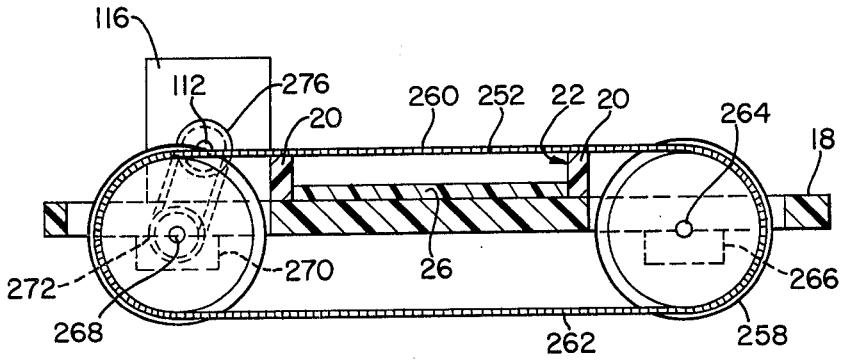
FIG. 12 is a sectional view on line 12—12 of FIG. 11.

In the FIGS. 11 and 12 embodiment, cutting blade 52 of primary cutting means 12 has been replaced by a bandsaw blade 252, which may have a serrated or saw tooth cutting edge 254, as shown for frozen meat, or a knife edge, (not shown), for fresh meat.

Bandsaw blade 252 is entrained about a pair of spaced drums 256 and 258, each disposed outboard of one of the guides 20, has an upper reach 260 which passes over the members 20 and a lower reach 262 which passes below base member 18.

Drum 258 is fixed to a shaft 264 journalled relative to a bracket 266 on base 18 and drum 256 is fixed to a shaft 268 journalled relative to a bracket 270 on base 18.

Shaft 268 has a pulley 272 fixed to its outer end, the pulley having a belt 274 passing therearound and around a pulley 275 fixed to the free end of shaft extension 112, whereby rotation of shaft extension 112 sets up a concomittant rotation of drum 256 to rotate bandsaw blade 252.

In the FIGS. 13 – 16 embodiment, cutting blade 52 of primary cutting means 12 has been replaced by a blade 352 specifically designed for use with frozen meat product and having a novel configuration for reclaiming meat dust created as the reciprocating blade cuts the frozen meat.

Blade 352 has a cutting edge 354 which includes a plurality of identical equi-spaced teeth 356 which extend outwardly from the body of the blade, each alternate tooth being offset upwardly or downwardly relative to the plane of the upper face of the blade.

Teeth 356 are separated by a plurality of equi-spaced, identical, open-mouthed recesses or gullets 358 or frusto-conical shape, each of which is bordered at its opposite sides by oppositely inclined side walls 360 and 362 of adjacent teeth and has a base wall 364 which extends horizontally between side walls 360 and 362.

Base wall 364 is chamferred or bevelled at both the upper and lower faces of the blade to provide a knife edge 366 facing into each recess 358, for purposes to appear.

Each tooth 356 is of inverted, substantially frusto-conical shape and, in addition to the side walls 360 and 362 which converge inwardly from the outer edge of the tooth to base wall 364, has a V-notch 368 in said outer edge.

The V-notch 368 is additionally chamferred or bevelled at both the upper and lower faces of the tooth to provide oppositely and outwardly facing knife edges 370, whereby the teeth cut in both directions of movement of the blade as it reciprocates.

The novel configuration of the teeth 356 and the recesses or gullets 358, and the alternating offset arrangement of the teeth, provides for great blade efficiency and economy in the preservation of meat dust which, with prior art blades, is normally lost when frozen meat product is cut.

Herein, as the blade 352 reciprocates, meat dust is allowed to pass between the oppositely offset teeth through the recesses 358 and, due to the bevelled configuration 366 of the base wall 364 and the bevelled configuration 370 of the V-notch 368, meat dust passes freely back to the meat product where it is readhered to the product as the blade reciprocates.

The FIG. 16*a* embodiment differs from that of FIG. 16 only in that the V-notch 368 in the teeth has been replaced by a single inclined edge, wherefore each tooth 456 of a blade 452 has an outer edge 468 which is angularly disposed relative to the longitudinal axis of the blade.

As with the FIG. 13 embodiment, blade 452 has a plurality of identical equi-spaced teeth 456 which extend outwardly from the body of the blade, each alternate tooth being offset upwardly or downwardly relative to the plane of the upper face of the blade.

Teeth 456 are separated by a plurality of equi-spaced, identical, open-mouthed recesses or gullets 458, each of which is bordered at one side by an inclined side wall 460 of one tooth and at its opposite side by the inclined edge 468 of the next adjacent tooth, and has a base wall 464 which extends horizontally between the wall 460 and the lower end of edge 468.

Base wall 464 is chamferred or bevelled at both the upper and lower faces of the blade to provide a knife edge 466 facing into each recess 458.

The edge 468 of each tooth 456 is chamferred or bevelled at both the upper and lower faces of the tooth in the manner of a knife edge.

The blade of FIG. 16*a* will cut in only one direction of movement as it reciprocates, while that of FIG. 13 cuts in both directions of movement as it reciprocates.

However, with the blades of both embodiments, meat dust is reclaimed.

In the FIG. 17 embodiment, the annular cutting knives 56 and 98 have been replaced by annular cutting knives 398, each knife having saw teeth 399 on its periphery for cutting frozen meat product.

The knives 398 rotate in the direction of the arrow, with the angle of the teeth being such that the meat dust readheres to the meat product and is carried along with the strips and cubes in the second and third cutting stages.

I claim:

1. Apparatus for cubing frozen meat comprising, first cutting means for cutting a slab from a piece of meat, second cutting means for cutting the slab longitudinally into strips, and third cutting means for cutting the strips transversely into cubes, wherein the first cutting means is a horizontally reciprocable cutting blade having a cutting edge comprised of a plurality of equi-spaced teeth alternately offset upwardly or downwardly relative to the plane of the cutting blade, and wherein the second and third cutting means each comprise a plurality of upright annular rotatable saw tooth cutting blades, the first and second cutting means being disposed in a horizontally disposed first meat channel, and the third cutting means being disposed in a horizontally disposed second meat channel normal to the first meat channel, a first meat ram slidable in the first meat channel, a second meat ram slidable in the second meat channel, a meat hopper linked to and slidable with the first meat ram, and a strip guide having a plurality of partitions in the second meat channel for guiding strips of meat, and handle means for effecting vertical movement of the strip guide for clearing the partitions from the second meat channel, whereby manual inward sliding movement of the first meat ram first causes a slab to be cut from meat within the hopper by the first cutting means with meat dust being reclaimed as the cutting blade of the first cutting means reciprocates, second causes the so-cut slab to be sliced into strips by the second cutting means, with meat dust produced as the so-sliced strips are cut by the second cutting means being reclaimed, and third causes the so-sliced strips to be moved into the second meat channel between the partitions of the strip guide for retaining the strips in alignment, with manual vertical upward movement of the strip guide moving the partitions out of the second meat channel whereby manual inward sliding movement of the second meat ram causes the aligned strips to be moved to the third cutting means for cubing, with meat dust produced as the strips are cubed by the third cutting means being reclaimed.

2. Apparatus according to claim 1, wherein the teeth of the cutting blade of the first cutting means are of inverted substantially frusto-conical shape and are separated by gullets of frusto-conical shape.

3. Apparatus according to claim 2, wherein the outwardly facing edge of each tooth and the outwardly facing base of each gullet are chamferred.

4. Apparatus according to claim 1, wherein each tooth is provided with a V-notch in its outwardly facing edge.

5. Apparatus according to claim 1, wherein each tooth is provided with an angular cutting edge.

* * * * *